US012264673B2

(12) United States Patent
Moreno et al.

(10) Patent No.: US 12,264,673 B2
(45) Date of Patent: Apr. 1, 2025

(54) ELECTRONIC POSITIVE DISPLACEMENT FLUID PUMP WITH MOTOR COOLING AND AIR PURGING

(71) Applicant: PHINIA Jersey Holdings LLC, Wilmington, DE (US)

(72) Inventors: Alejandro Moreno, El Paso, TX (US); Aldo Darien Venegas Carrillo, Cd. Juarez (MX)

(73) Assignee: PHINIA JERSEY HOLDINGS LLC, Wilmington, DE (US)

( * ) Notice: Subject to any disclaimer, the term of this patent is extended or adjusted under 35 U.S.C. 154(b) by 0 days.

(21) Appl. No.: 18/128,526

(22) Filed: Mar. 30, 2023

(65) Prior Publication Data

US 2024/0328415 A1 Oct. 3, 2024

(51) Int. Cl.
*F04C 2/12* (2006.01)
*F04B 17/03* (2006.01)
(Continued)

(52) U.S. Cl.
CPC ..... *F04C 2/123* (2013.01); *F04B 17/03* (2013.01); *F04C 7/00* (2013.01); *F04C 15/0088* (2013.01);
(Continued)

(58) Field of Classification Search
CPC ..... F04C 2/082; F04C 2/088; F04C 2/123; F04C 7/00; F04C 15/0023; F04C 15/0026;
(Continued)

(56) References Cited

U.S. PATENT DOCUMENTS 3,212,449 A * 10/1965 Whalen ..... F04C 15/0053 418/75
4,697,995 A * 10/1987 Tuckey ..... F04C 15/0023 418/133

(Continued)

FOREIGN PATENT DOCUMENTS

WO 2008032514 A1 3/2008

OTHER PUBLICATIONS

International Search Report of the International Searching Authority for PCT/US2024/020739, dated Jul. 18, 2024 (1 page).

*Primary Examiner* — Theresa Trieu
(74) *Attorney, Agent, or Firm* — Warner Norcross + Judd LLP

(57) ABSTRACT

A positive displacement fluid pump is provided. The fluid pump includes a housing defining an internal cavity. A motor having a drive shaft that rotates about an axis is housed within the internal cavity of the housing. An internal plate is adjacent the motor and includes a central bore through which the drive shaft extends. The fluid pump further includes an external plate including an inlet in fluid communication with a suction port and an outlet in fluid communication with a delivery port. A pumping ring is sandwiched between the internal and external plates, and a pumping arrangement is located within the pumping ring and axially between the internal plate and the external plate. The pumping arrangement is rotatably coupled to the drive shaft such that rotation of the pumping arrangement by the drive shaft causes fluid to be pumped from the suction port to the delivery port.

21 Claims, 12 Drawing Sheets

(51) Int. Cl.

| | |
|---|---|
| ***F04C 7/00*** | (2006.01) |
| ***F04C 15/00*** | (2006.01) |
| ***F04C 15/06*** | (2006.01) |
| *F04C 29/00* | (2006.01) |

(52) U.S. Cl.
CPC ..... *F04C 15/06* (2013.01); *F04C 29/0092* (2013.01); *F04C 2210/1044* (2013.01)

(58) Field of Classification Search
CPC .. F04C 15/0088; F04C 15/06; F04C 29/0092; F04C 2210/1044; F04B 17/03
See application file for complete search history.

(56) References Cited

U.S. PATENT DOCUMENTS

| | | | | |
|---|---|---|---|---|
| 6,481,991 | B2 * | 11/2002 | Takagi | F04C 2/103 418/171 |
| 2012/0224991 | A1 * | 9/2012 | Lipinski | F04C 2/103 418/166 |
| 2015/0017049 | A1 * | 1/2015 | Naiki | F04C 2/102 418/171 |
| 2015/0300355 | A1 * | 10/2015 | Malvasi | F04D 13/06 417/366 |
| 2020/0018309 | A1 * | 1/2020 | Kobayashi | F04C 2/102 |
| 2021/0277894 | A1 | 9/2021 | Homma et al. | |
| 2022/0090597 | A1 | 3/2022 | Rosinski et al. | |
| 2022/0275803 | A1 | 9/2022 | Crosio | |

* cited by examiner

ELECTRONIC POSITIVE DISPLACEMENT FLUID PUMP WITH MOTOR COOLING AND AIR PURGING

FIELD OF THE INVENTION

The disclosure generally relates to positive displacement fluid pumps and, more specifically, to electronic positive displacement pumps for pumping fluids such as oil or fuel.

BACKGROUND OF THE INVENTION

Electro-hydraulic pumps are electromechanical apparatuses in which mechanical energy generated by a motor is transferred to a hydraulic pump section that moves a fluid to provide fluid flow and fluid pressure in a hydraulic circuit. Examples of these pumps used in vehicles include gear pumps such as electronic fuel pumps (EFPs) that feed fuel from the fuel delivery module (FDM) in the fuel tank to a combustion engine of the vehicle. Other examples include electronic oil pumps that move hydraulic fluid to cool and lubricate the internal mechanisms of, for example, an integrated drive module (IDM), such as the drive motor and gear box of the IDM. These electronic pumps may be directly commutated ("brush") pumps that are driven by a constant voltage signal or electronically commutated ("brushless") pumps that are driven by dedicated pump controllers. Common electronically commutated pumps include a housing assembly that houses the motor and a circuit board that operates the motor. A pumping section that is driven by the motor is also located in the housing. The pumping section may include, for example, an internal plate, a gerotor assembly that is disposed in the internal plate, and an external plate that closes the housing and includes inlet and outlet ports.

The use of electronically commutated pumps in the field of automotive vehicles has increased with the demand for greater vehicle fuel economy as well as greater drive range for electric vehicles (EVs). This demand requires that the pumps and systems that use them are more robust and efficient, while also offering these improvements at a lower cost. For example, increasing the service life of these pumps requires efficient and effective thermal management so that heat generated by the motor coils and friction/wear between sliding surfaces do not cause premature failure of the pump components. There are various configurations for cooling and lubricating the internal pump components. In cases in which the pump is submerged in a fluid reservoir, passages on the motor section of the pump connect the fluid reservoir to the internal motor chamber and allow fluid from the fluid reservoir to be drawn into and circulate through the motor chamber due to pressure gradients generated in the pump section. Cooling and lubricating of the pump become more difficult if the pump is not submerged in fluid, whereby fluid from the pumping section must be used to perform these functions without adversely affecting pump flow and pressure, as well as without significantly increasing the cost of the pump components. Additionally, fluid may not be completely filled in the motor section of the pump due to trapped air in the motor section.

BRIEF SUMMARY

An improved positive displacement fluid pump is provided. The positive displacement fluid pump includes a housing defining an internal cavity. A motor is housed within the internal cavity of the housing. The motor has a drive shaft that rotates about an axis. The fluid pump further includes an internal plate adjacent the motor. The internal plate includes a central bore through which the drive shaft extends. The fluid pump further includes an external plate including an inlet in fluid communication with a suction port and an outlet in fluid communication with a delivery port. A pumping ring is sandwiched between the internal and external plates. A pumping arrangement is rotatably coupled to the drive shaft such that rotation of the pumping arrangement by the drive shaft causes fluid to be pumped from the suction port to the delivery port. The pumping arrangement is located within the pumping ring and axially between the internal plate and the external plate.

In specific embodiments, the internal plate includes an inwardly-facing face surface, an opposite outwardly-facing face surface, and a complementary delivery port formed in the outwardly-facing face surface and in fluid communication with the delivery port of the external plate.

In particular embodiments, the internal plate further includes a fill passage connected to the complementary delivery port, the fill passage extending to the inwardly-facing face surface of the internal plate and being in fluid communication with the internal cavity of the housing. Fluid pumped by the pumping arrangement is delivered to the internal cavity of the housing through the fill passage.

In certain embodiments, the fill passage is cylindrical.

In particular embodiments, the internal plate includes a hub protruding from the inwardly-facing face surface of the internal plate. The central bore is formed at least in part in the hub, and the hub includes at least one lubrication passage connecting the internal cavity of the housing to the central bore.

In certain embodiments, the at least one lubrication passage is cylindrical.

In certain embodiments, the fluid pump includes two of the lubrication passages.

In certain embodiments, the two lubrication passages are offset approximately 180 degrees from each other in a radial direction around the hub.

In specific embodiments, the fluid pump includes a purge pathway from the internal cavity to the suction port, the purge pathway extending through the internal plate and the pumping ring.

In particular embodiments, the purge pathway further extends from the pumping ring into the external plate.

In certain embodiments, the internal plate includes an inwardly-facing face surface and an opposite, outwardly-facing face surface adjacent the pumping ring. The external plate includes an inwardly-facing face surface adjacent the pumping ring. A groove is formed in the inwardly-facing face surface of the external plate, and the groove is connected to the suction port. The pumping ring includes an inwardly-facing face surface adjacent the outwardly-facing face surface of the internal plate, and an opposite, outwardly-facing face surface adjacent the inwardly-facing face surface of the external plate. The outwardly-facing face surface of the pumping ring includes a channel formed therein. One end of the channel is connected to the groove in the external plate and another end of the channel is connected to a passage that extends through the pumping ring from the outwardly-facing face surface of the pumping ring to the inwardly-facing face surface of the pumping ring. The internal plate includes a purge passage extending from the outwardly-facing face surface of the internal plate to the inwardly-facing face surface of the internal plate. The purge passage in the internal plate is connected to the passage in the pumping ring. The purge pathway is defined by the purge passage in the internal plate, the passage in the pumping ring, the channel in the pumping ring, and the groove in the external plate.

In certain embodiments, the purge passage protrudes from the internal plate into the internal cavity of the housing.

In certain embodiments, the purge passage is in fluid communication with the internal cavity of the housing.

In specific embodiments, the pumping arrangement and the pumping ring are made of materials having a similar coefficient of thermal expansion (CTE).

In specific embodiments, the pumping arrangement includes a rotating element that is an inner gear rotor mounted on the drive shaft, and the pumping arrangement further includes an outer gear rotor engaged and driven by the inner gear rotor. The inner gear rotor and outer gear rotor together define a plurality of variable volume pumping chambers in fluid communication with the suction port and the delivery port.

In particular embodiments, the pumping ring is an eccentric ring including a circular gear rotor bore that is offset from the axis of the drive shaft.

In specific embodiments, the motor is an electric motor.

In specific embodiments, the inlet is arranged in an axial direction aligned with the axis of the drive shaft, and the outlet is arranged in one of: (i) the axial direction; or (ii) a radial direction extending radially with respect to the axis of the drive shaft.

In specific embodiments, (i) the inlet and outlet are isolated from the internal cavity; (ii) the inlet is isolated from the internal cavity and the outlet is open to the internal cavity; or (iii) the inlet is open to the internal cavity and the outlet is isolated from the internal cavity.

In specific embodiments, one of the suction port and the delivery port is in fluid communication with the internal cavity such that fluid is either delivered from the suction port or the delivery port to the internal cavity.

A method of cooling and lubricating the positive displacement pump is also provided. The method includes forming a complementary delivery port in an outwardly-facing face surface of the internal plate. The complementary delivery port is in fluid communication with the delivery port of the external plate. The method further includes forming a fill passage in the internal plate. The fill passage is connected to the complementary delivery port, the fill passage extends to an inwardly-facing face surface of the internal plate, and the fill passage is in fluid communication with the internal cavity of the housing. Fluid pumped by the pumping arrangement is delivered to the internal cavity of the housing through the fill passage.

In specific embodiments, the method further includes forming at least one lubrication passage in a hub of the internal plate. The hub is a smaller diameter portion that protrudes from the inwardly-facing face surface of the internal plate, and the central bore is formed at least in part in the hub. The at least one lubrication passage connects the internal cavity of the housing to the central bore. Fluid is delivered from the internal cavity of the housing to the central bore through the at least one lubrication passage.

In specific embodiments, the method further includes forming a groove in the inwardly-facing face surface of the external plate. The method also includes forming a channel in an outwardly-facing face surface of the pumping ring. One end of the channel is connected to the groove in the external plate and another end of the channel is connected to a passage that extends through the pumping ring from the outwardly-facing face surface of the pumping ring to an inwardly-facing face surface of the pumping ring. The method also includes forming a purge passage that extends from an outwardly-facing face surface of the internal plate to an inwardly-facing face surface of the internal plate. The purge passage in the internal plate is connected to the passage in the pumping ring. Air is bled from the internal cavity of the housing serially through the purge passage in the internal plate, the passage in the pumping ring, the channel in the pumping ring, and the groove in the external plate to the suction port.

In particular embodiments, fluid delivered to the internal cavity of the housing through the fill passage is recirculated from the internal cavity to the suction port serially through the purge passage in the internal plate, the passage in the pumping ring, the channel in the pumping ring, and the groove in the external plate.

DESCRIPTION OF THE DRAWINGS

Various advantages and aspects of this disclosure may be understood in view of the following detailed description when considered in connection with the accompanying drawings, wherein.

DETAILED DESCRIPTION OF THE INVENTION

A positive displacement fluid pump is provided. Referring to FIGS. 1-14(*b*), wherein like numerals indicate corresponding parts throughout the several views, the positive displacement fluid pump (also referred to as the fluid pump herein) is illustrated and generally designated as an oil pump 10 for pumping liquid oil from a reservoir 12 to an integrated drive module (IDM) of an electric or hybrid vehicle to cool and lubricate the internal working mechanisms of the IDM including the IDM drive motor 13 and gear box 14. While the fluid pump is illustrated as oil pump 10 for an IDM, it should be understood that the invention is not limited to an oil pump, but could also be applied to fluid pumps for pumping fluids other than oil, such as but not limited to fuel, and in other applications other than for an IDM. The oil pump 10 provides for improved internal cooling and lubrication as well as air purging of the motor section of the pump. Particularly, the oil pump 10 has a pumping section that includes a pumping ring that is separate from the plates of the pumping section. The pumping ring contains that pumping arrangement of the pumping section, while the plates include ports and passages that control the direction of fluid flow displaced by the pump section. Separation of the plates from the pumping ring allows for additional ports and passages to be molded in the plates. Certain features of the oil pump 10 are functional, but can be implemented in different aesthetic configurations.

Figure 1:
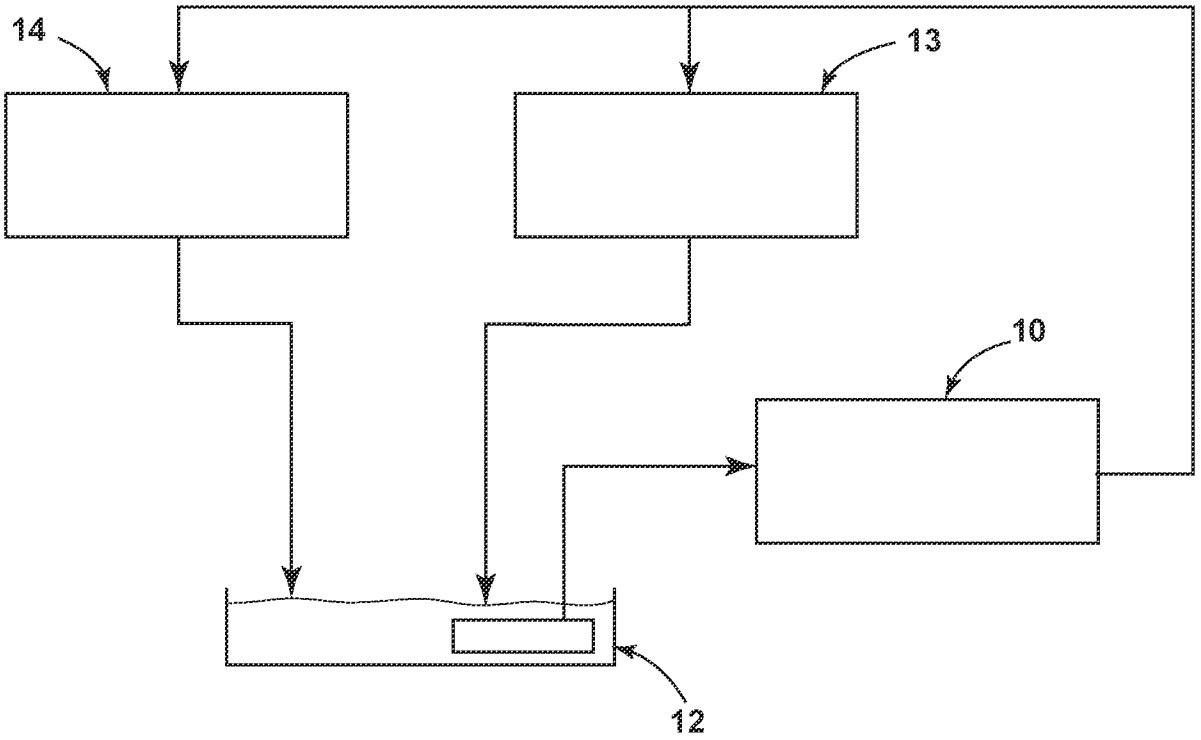
FIG. 1 is a schematic view of an integrated drive module including a positive displacement fluid pump in accordance with embodiments of the disclosure.
Figure 2:
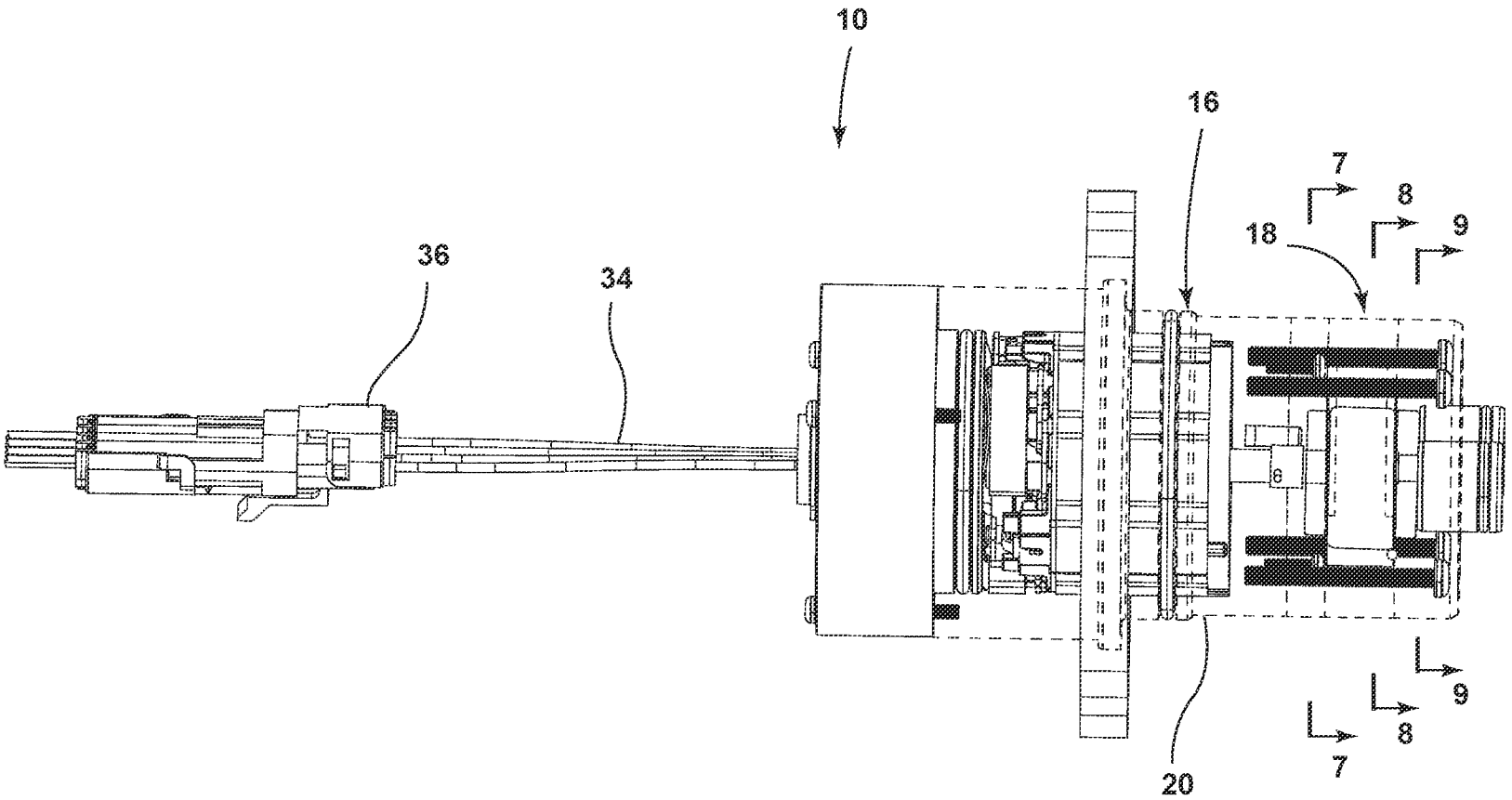
FIG. 2 is a perspective view of a positive displacement fluid pump in accordance with some embodiments of the disclosure, with certain components of the pump shown partially transparent to reveal internal features.
Figure 3:
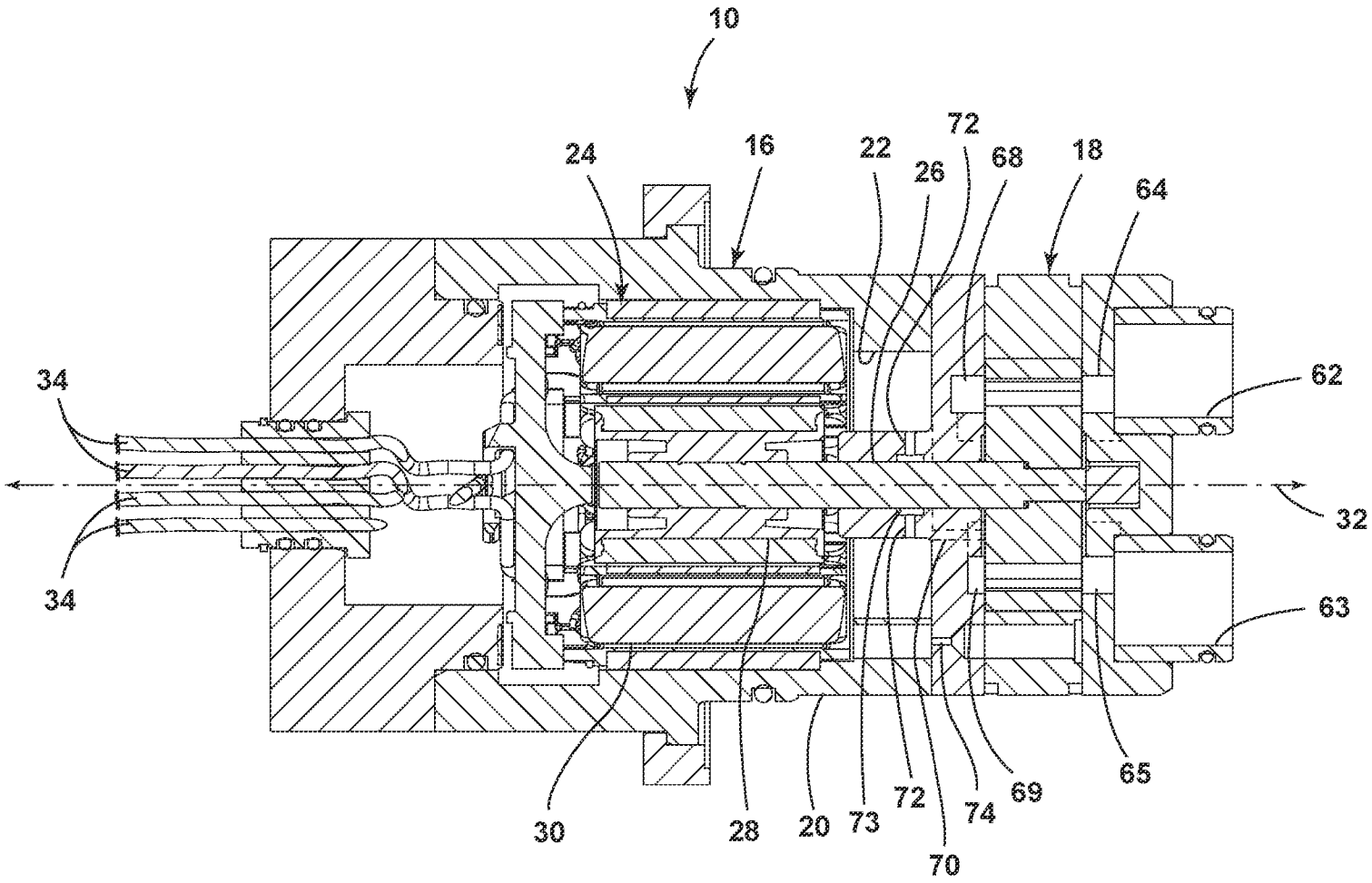
FIG. 3 is a sectional view of the positive displacement fluid pump of FIG. 2.
Figure 4:
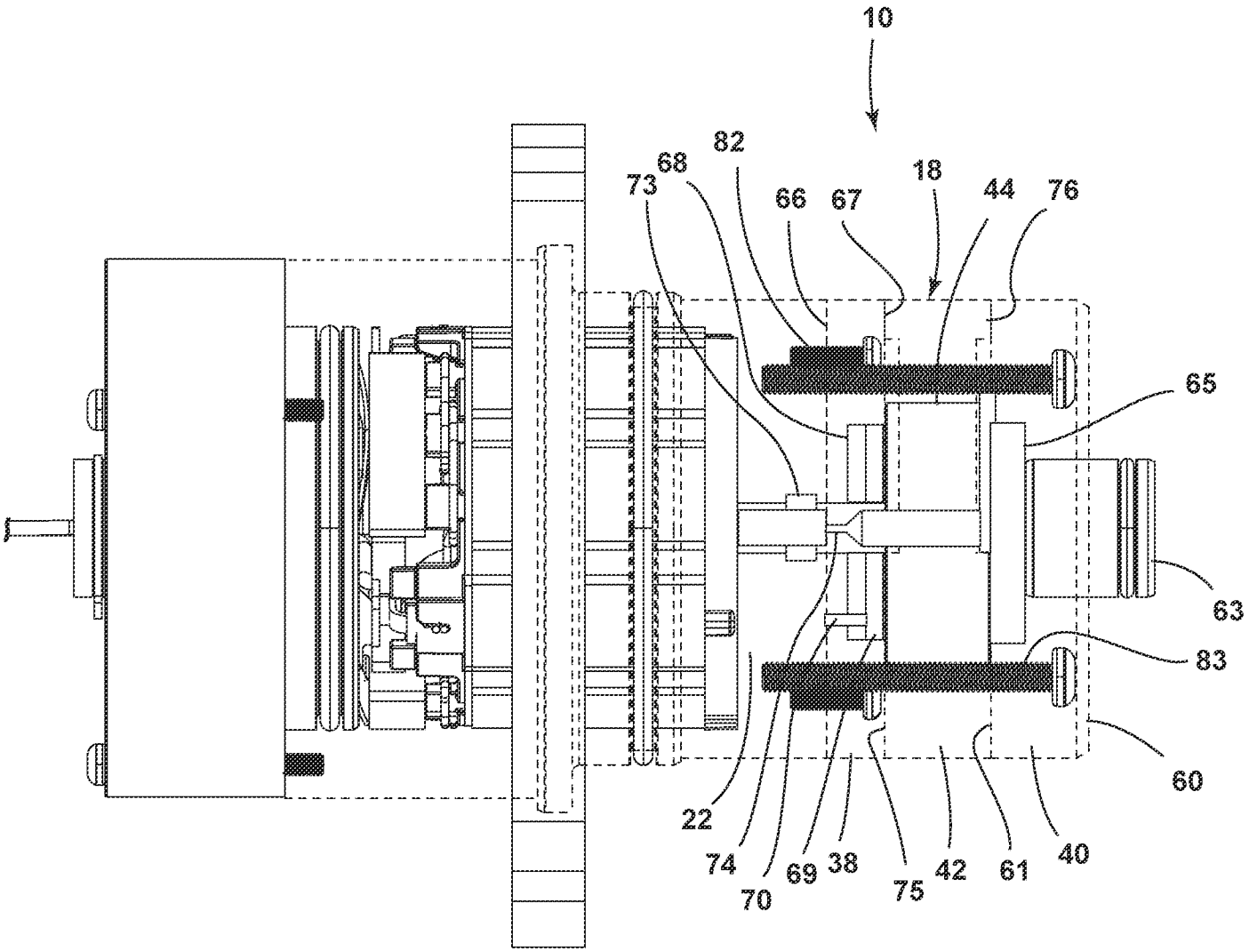
FIG. 4 is an enlarged perspective view of a portion of the positive displacement fluid pump with certain components of the pump shown partially transparent to reveal internal features.
Figure 5:
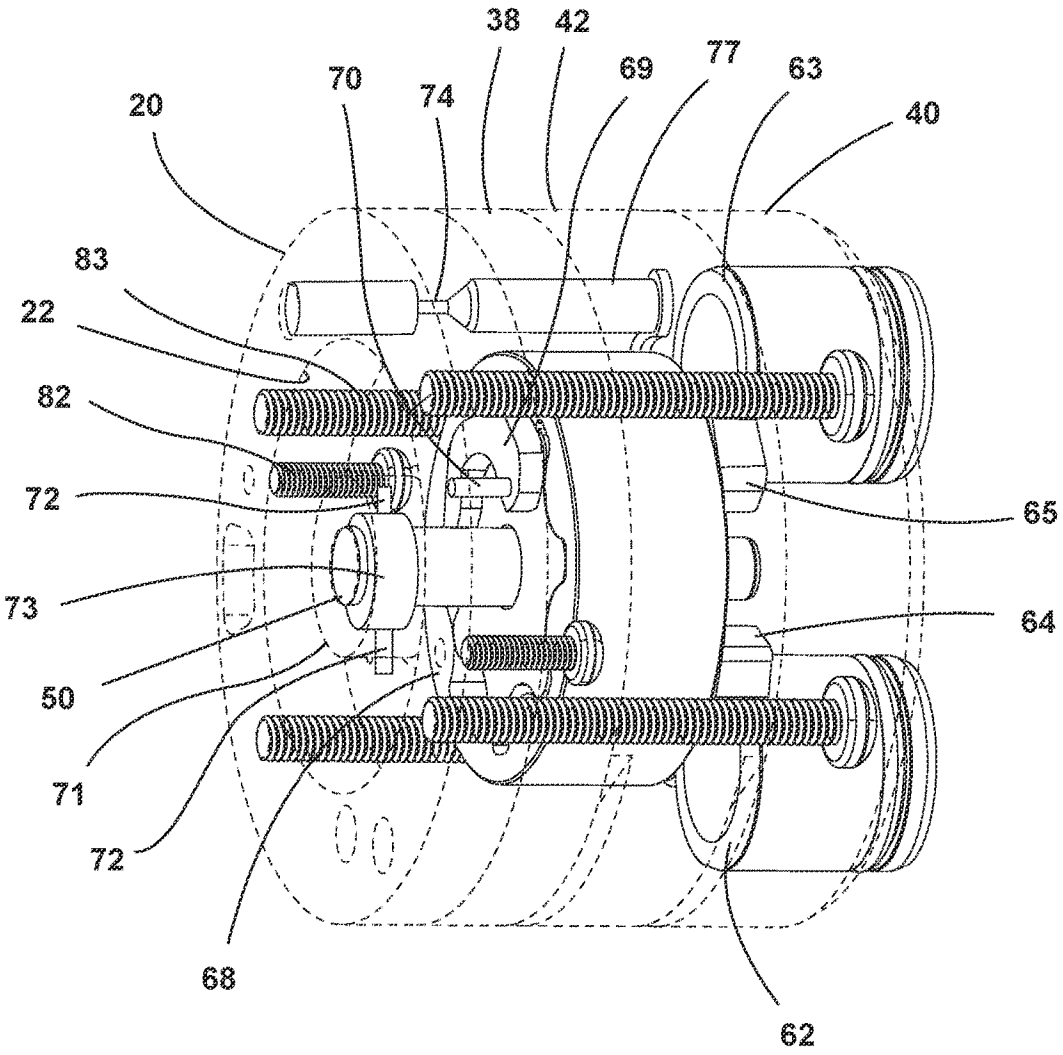
FIG. 5 is a perspective view of a pumping section of the positive displacement fluid pump with certain components of the pumping section shown partially transparent to reveal internal features.
Figure 6:
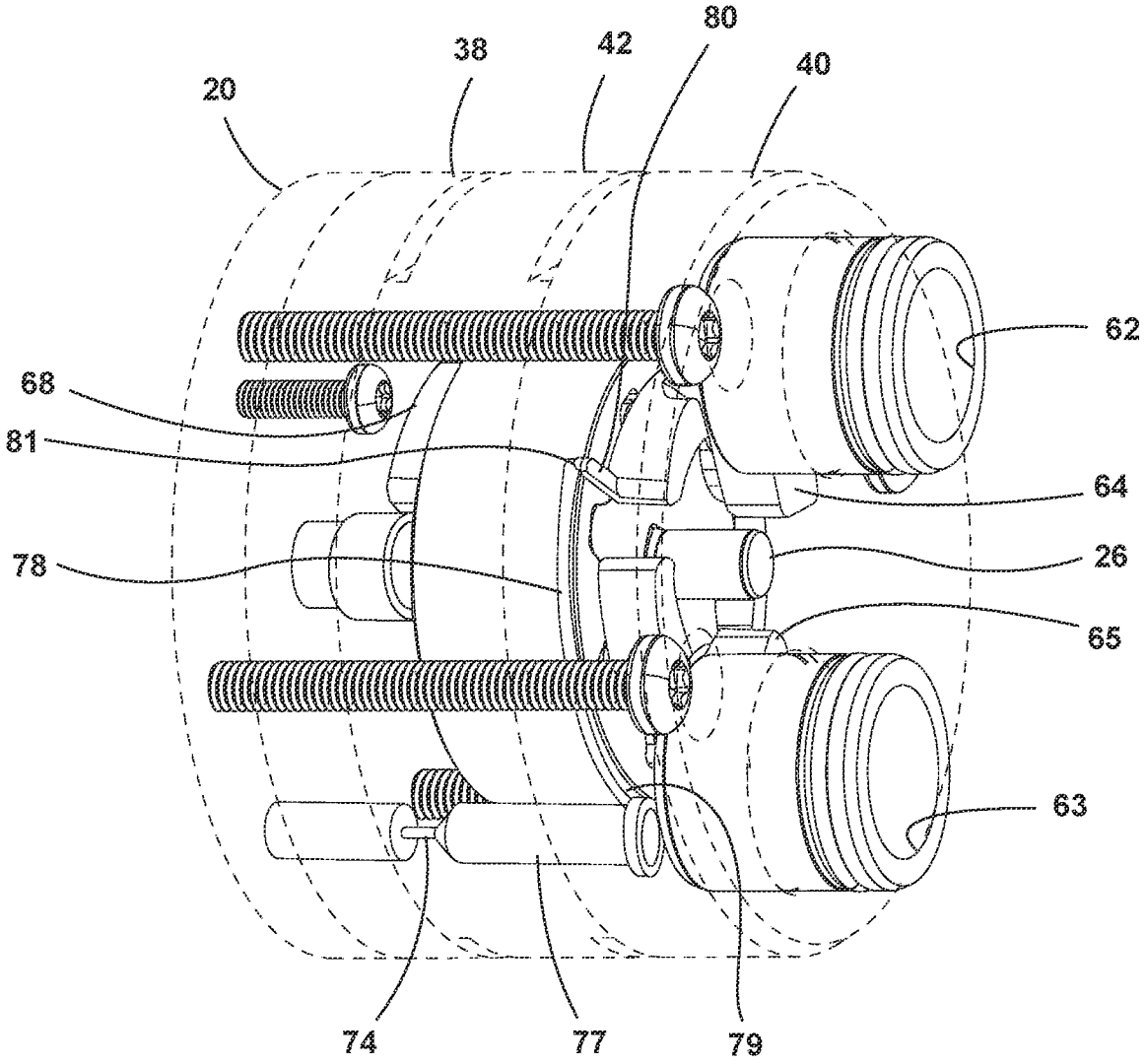
FIG. 6 is another perspective view of a pumping section of the positive displacement fluid pump with certain components of the pumping section shown partially transparent to reveal internal features.
Figure 7:
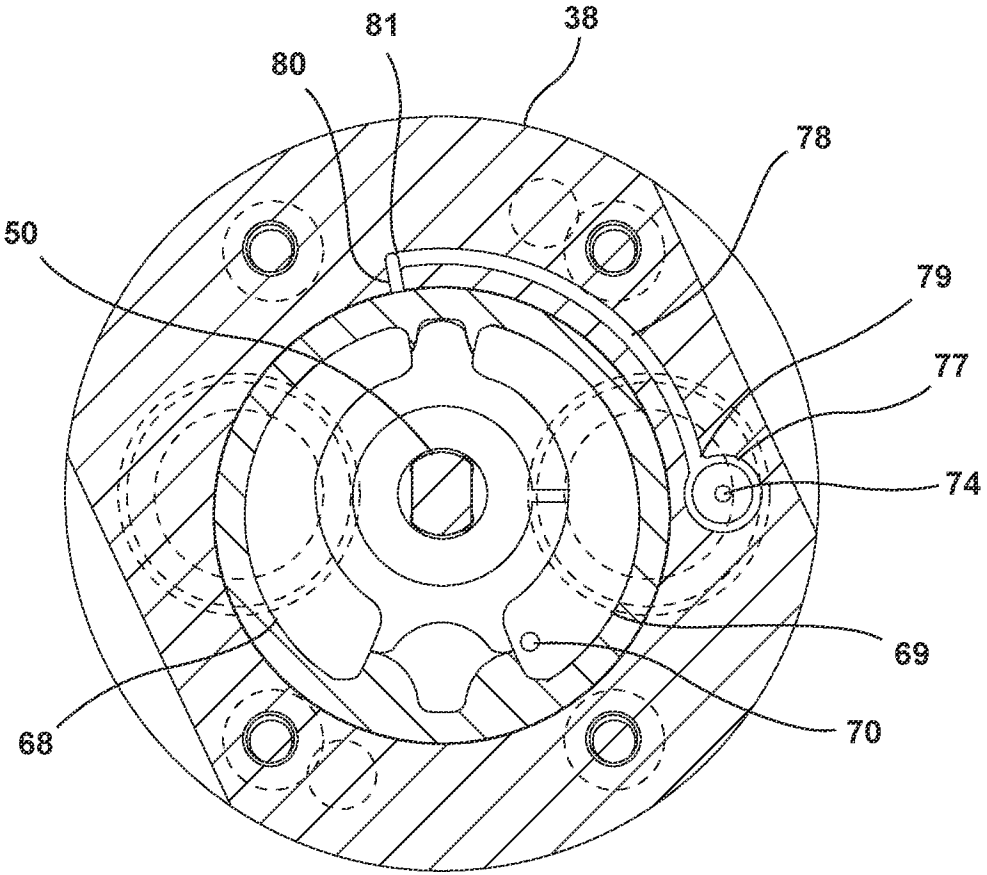
FIG. 7 is a cross-sectional view of the positive displacement fluid pump taken along the line 7-7 in FIG. 2.
Figure 8:
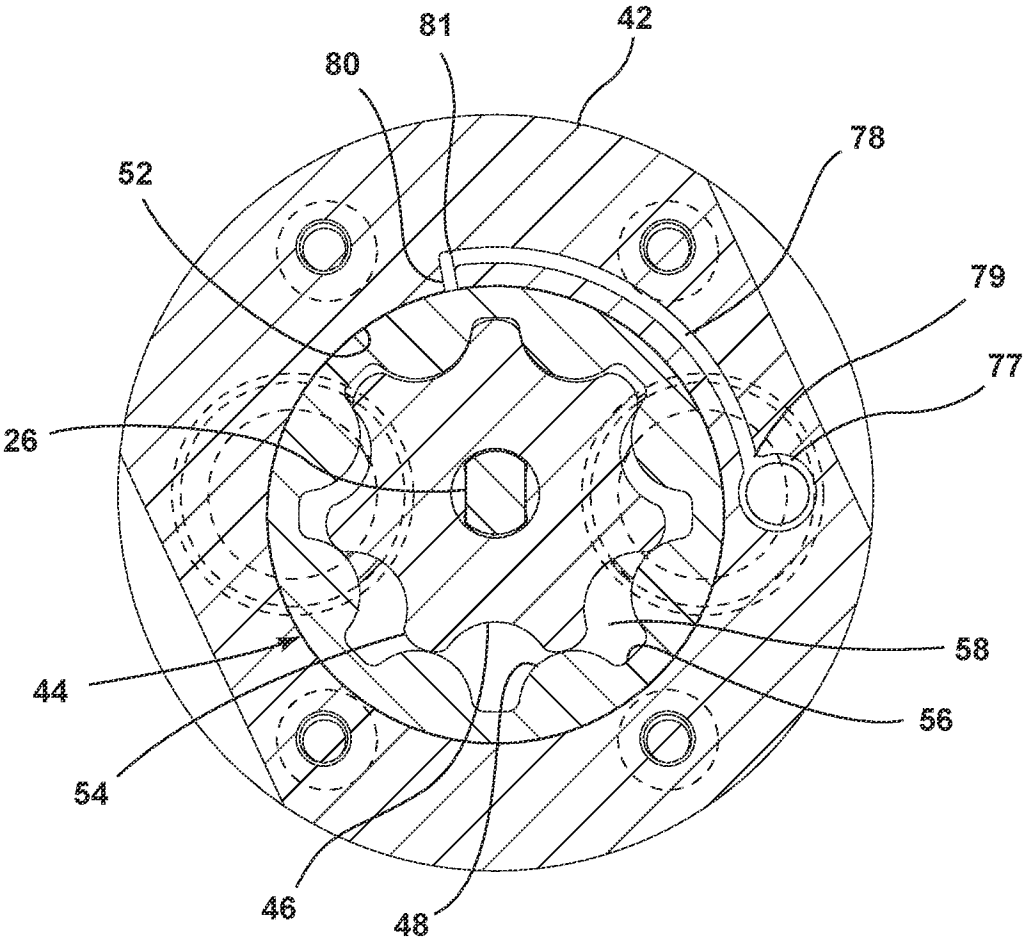
FIG. 8 is a cross-sectional view of the positive displacement fluid pump taken along the line 8-8 in FIG. 2.
Figure 9:
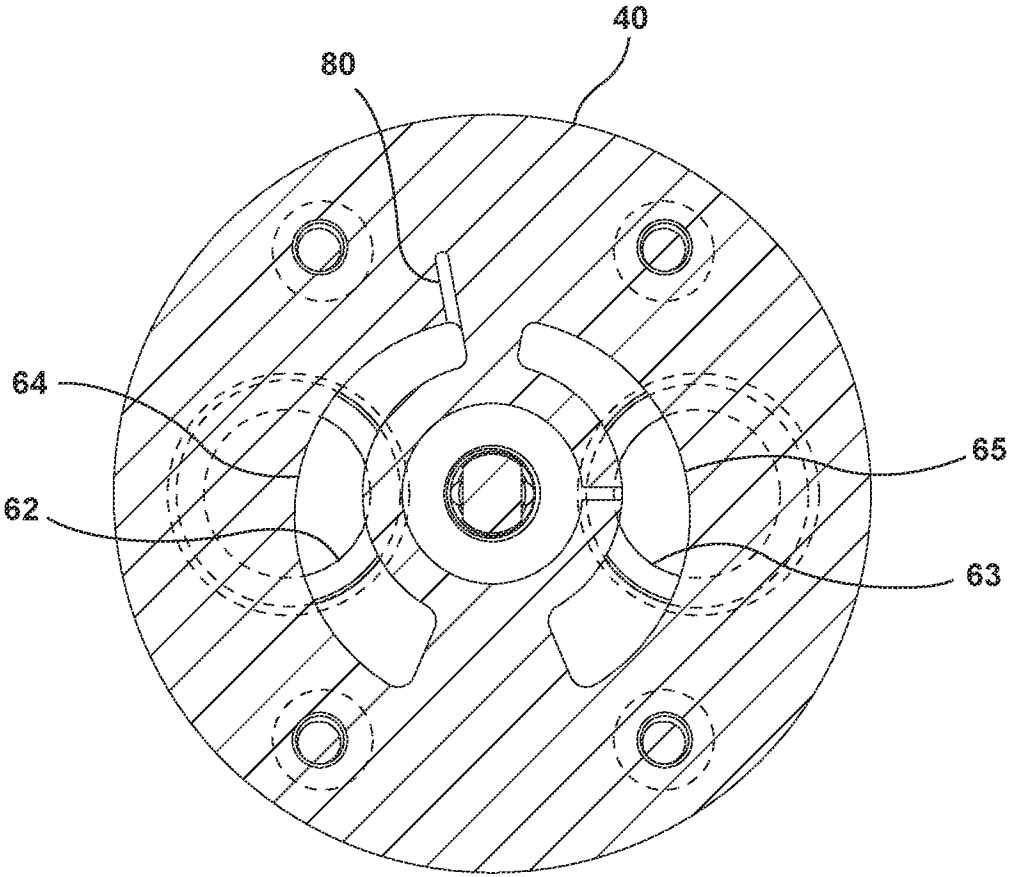
FIG. 9 is a cross-sectional view of the positive displacement fluid pump taken along the line 9-9 in FIG. 2.

With reference to FIGS. 2 and 3, the oil pump 10 generally includes a motor section 16, and a pumping section 18 adjacent to motor section 16. A housing 20 of the oil pump 10 includes an internal motor cavity 22 in which the motor section 16 is retained. Low pressure oil enters oil pump 10 at pumping section 18, a portion of which is rotated by the motor section 16 as will be described in more detail below, and is pumped out of the pumping section 18 at a higher pressure than the inlet pressure.

Motor section 16 includes an electric motor 24 which is disposed within the motor cavity 22 of the housing 20. The electric motor 24 may be, for example, an electronically commutated (EC) brushless motor. Electric motor 24 includes a shaft 26 extending therefrom into the pumping section 18. A permanent magnet rotor 28 is attached at an opposite end of the shaft 26, and the rotor 28 is surrounded by a stator 30. Shaft 26 rotates about a first axis 32 when an electric current is applied to the stator 30 of the electric motor 24. The electric motor 24 is connected to a supply of power and an external controller by wires 34 connected to a wire harness 36. Electric motors and their operation are well known, consequently, electric motor 24 will not be discussed further herein.

With continued reference to FIG. 3 and now with additional reference to FIGS. 4-9, in an exemplary embodiment the pumping section 18 forms a head that generally closes the motor cavity 22 and includes an internal plate 38, an external plate 40, a pumping ring 42 sandwiched between the internal plate 38 and the external plate 40, and a pumping arrangement 44 rotatably coupled to the drive shaft 26. By way of non-limiting example, the pumping arrangement 44 is shown as a gerotor. The pumping arrangement 44 thus includes a rotating drive element that is illustrated as an inner gear rotor 46. The pumping arrangement 44 is also illustrated as including an outer gear rotor 48 that is a rotating driven element. Collectively, inner gear rotor 46 and outer gear rotor 48 will be referred to herein as pumping arrangement 44. External plate 40 is disposed at an end of pumping section 18 that is distal from motor section 16 while internal plate 38 is disposed at an end of pumping section 18 that is proximal to the motor section 16 and the internal cavity 22 of the housing 20. The drive shaft 26 extends through a central bore 50 in the internal plate 38 and is connected to the pumping arrangement 44. Pumping arrangement 44 is rotatably disposed within a circular gear rotor bore 52 formed within the pumping ring 42, and the pumping arrangement 44 is located axially between the internal plate 38 and the external plate 40. Gear rotor bore 52 is centered about a second axis (not shown) which is parallel and laterally offset relative to drive shaft axis 32. In this manner, the pumping ring 42 is in the form of an eccentric ring. Gear rotor bore 52 is diametrically sized to allow the outer gear rotor 48 to rotate freely therein while substantially preventing radial movement of outer gear rotor 48. The inner gear rotor 46 includes a plurality of external teeth 54 on the outer perimeter thereof which engage complementary internal tooth recesses 56 of the outer gear rotor 48, thereby defining a plurality of variable volume pumping chambers 58 between the inner gear rotor 46 and the outer gear rotor 48 that increase and decrease in size to suck and pressurize fluid such as the oil pumped by the pump 10. It should be noted that only representative external teeth 54, internal tooth recesses 56 and pumping chambers 58 have been labeled in the drawings. As shown, the inner gear rotor 46 has seven external teeth 54 while the outer gear rotor 48 has eight internal tooth recesses 56; however, it should be understood that inner gear rotor 46 may have any number n external teeth 54 while outer gear rotor 48 has n+1 internal tooth recesses 56.

Since the eccentric pumping ring 42 is separate from both the internal plate 38 and the external plate 40, it is possible to construct the pumping ring 42 from a material that has a similar coefficient of thermal expansion (CTE) as the pumping arrangement 44 (i.e., inner and outer gear rotors 46, 48). This provides for reduced axial clearance variation between the pumping ring 42 and the pumping arrangement 44 within the operating temperature range of the oil pump 10, which is typically in the range of −40° C. and 150° C. In certain embodiments, the pumping ring 42 and the pumping arrangement 44 may be constructed of the same or similar material. In certain embodiments, the pumping ring 42 and the pumping arrangement 44 may be constructed of the same or similar material. For example, the gears 46, 48 of the pumping arrangement 44 may be made of powdered metal or plastic (e.g., phenolic polymer or polyetheretherketone (PEEK)), while the eccentric pumping ring 42 may be made of aluminum or a phenolic polymer. In contrast, conventionally the pumping ring is integrated into one of the internal or external plates, which are made of cast aluminum, and the gear rotors are made of a material such as nickel steel powdered metal, which has half the CTE of aluminum.

The external plate 40 is disposed at the outer end of the oil pump 10 and includes outwardly-facing face surface 60 on the outside of the pump 10 and an inwardly-facing face surface 61 adjacent the pumping ring 42. A low-pressure inlet 62 and a high-pressure outlet 63 are formed in the outwardly-facing face surface 60 of the external plate 40. The inlet 62 and outlet 63 may include a conduit that extends outwardly beyond the outwardly-facing face surface 60 of the external plate 40. The inlet 62 is connected to and in fluid communication with (fluidly connected to) a suction port 64 formed in the inwardly-facing face surface 61 of the external plate 40. The outlet 63 is connected to and in fluid communication with a delivery port 65 formed in the inwardly-facing face surface 61 of the external plate 40. The inlet 62 and outlet 63 both face and extend in the axial direction (direction of drive shaft axis 32). However, it should be understood that the outlet may instead face in the radial direction relative to the drive shaft axis 32. The inlet 62 of the external plate 40 is aligned with a portion of gear rotor bore 52 within which the geometry between external teeth 54 and internal tooth recesses 56 create pumping chambers 58 of relatively large size while the outlet 63 of the external plate 40 is aligned with a portion of gear rotor bore 52 within which the geometry between external teeth 54 and internal tooth recesses 56 create pumping chambers 58 of relatively small size. When the electric motor 24 is rotated by application of an electric current, inner gear rotor 46 rotates about drive shaft axis 32. By virtue of external teeth 54 engaging internal tooth recesses 56, rotation of inner gear rotor 46 causes outer gear rotor 48 to rotate about the second axis. In this way, the volume of pumping chambers 58 decreases as each pumping chamber 58 rotates from being in communication with the inlet 62 (and suction port 64) to being in communication with the outlet 63 (and delivery port 65), thereby causing oil to be pressurized and pumped from the inlet 62 to the outlet 63.

The internal plate 38 is adjacent the electric motor 24 and includes an inwardly-facing face surface 66 that faces the internal cavity 22, an opposite outwardly-facing face surface 67 that is adjacent the pumping ring 42, and a complementary suction port 68 formed in the outwardly-facing face surface 67. The complementary suction port 68 is in fluid communication with the suction port 64 of the external plate 40 via the pumping chambers 58 of the pumping arrangement 44 that are intermediate the suction port 64 and the complementary suction port 68. Similarly, a complementary delivery port 69 is also formed in the outwardly-facing face surface 67 of the internal plate 38. The complementary delivery port 69 is in fluid communication with the delivery port 65 of the external plate 40 via the pumping chambers 58 of the pumping arrangement 44 that are intermediate the delivery port 65 and the complementary delivery port 69. A fill passage 70 is connected to and in fluid communication with the complementary delivery port 69. The fill passage 70 extends to the inwardly-facing face surface 66 of the internal plate 38 and is also in fluid communication with the internal cavity 22 of the housing 20. The fill passage 70 is not particularly limited in shape, and may be, for example, a small, cylindrically-shaped orifice from the complementary delivery port 69 to the inwardly-facing face surface 66 of the internal plate 38. The internal plate 38 further includes a hub 71 in the form of a smaller diameter portion protruding from the inwardly-facing face surface 66 of the internal plate 38, i.e. the hub 71 has a small diameter than the diameter of the inwardly-facing face surface 66. The central bore 50 of the internal plate 38 is formed at least in part in the hub 71, and the hub 71 includes at least one, preferably two, lubrication passages 72 connecting the internal cavity 22 of the housing 20 to the central bore 50. Similar to the fill passage 70, the lubrication passages 72 may each be an orifice having a cylindrical shape; however, the lubrication passages are not limited to any particular shape. The two lubrication passages 72 may be offset approximately 180 degrees from each other in a radial direction around the hub 71, although the lubrication passages may be arranged in other relative dispositions. The lubrication passages 72 are connected to an annular ring 73 that encircles and surrounds a portion of the drive shaft 26.

A purge passage 74 extends from the outwardly-facing face surface 67 of the internal plate 38 to the inwardly-facing face surface 66 of the internal plate 38. The purge passage 74 protrudes from the internal plate 38 into the internal cavity 22 of the housing 20 and is thereby in fluid communication with the internal cavity 22. The pumping ring 42 includes an inwardly-facing face surface 75 adjacent the outwardly-facing face surface 67 of the internal plate 38, and an opposite, outwardly-facing face surface 76 adjacent the inwardly-facing face surface 61 of the external plate 40. A through passage 77 extends through the pumping ring 42 from the outwardly-facing face surface 76 to the inwardly-facing face surface 75. A channel 78 is formed in the outwardly-facing face surface 76 of the pumping ring 42. The channel 78 extends arcuately around a portion of the pumping ring 42 and is connected on one end 79 to the through passage 77 through the pumping ring 42. Further, a groove 80 is formed in the inwardly-facing face surface 61 of the external plate 40. The groove 80 is connected to and in fluid communication with the suction port 64, and the groove 80 is also connected to and in fluid communication with the other end 81 of the channel 78 in the pumping ring 42. Alternatively, the channel 78 may be formed in the inwardly-facing face surface 75 of the pumping ring 42, and the groove 80 may be formed in the outwardly-facing surface 67 of the internal plate 38 such that the groove is connected to and in fluid communication with the complementary suction port 68.

The internal plate 38 is mounted to the housing by a plurality of fasteners 82, such as two bolts or similar, that extend through the internal plate 38 and into the sidewall of the housing 20. Further, the internal plate 38, the pumping ring 42, and the external plate 40 are connected together by a plurality of fasteners 83, such as four bolts or similar, that extend through the plates 38, 40 and pumping ring 42, and also beyond the internal plate 38 and into the sidewall of the housing 20.

In operation, electricity is applied to the electric motor 24 which causes pumping arrangement 44 to rotate via rotation of the drive shaft 26, thereby drawing oil in through inlet 62 into the suction port 64 and subsequently to the pumping chambers 58 and the complementary suction port 68 at an initial pressure which may be by way of non-limiting example only, 0 kPa. Rotation of pumping arrangement 44 further causes the volume of pumping chambers 58 to decrease as each pumping chamber 58 rotates from being in communication with suction port 64 to being in communication with the delivery port 65 and complementary delivery port 69, thereby causing oil to be pressurized to a final pressure which is much greater than the initial pressure, and pumped from the delivery port 65 to the outlet 63. Simultaneously, the oil pumped by the pumping arrangement 44 is delivered to the internal cavity 22 of the housing 20 through the fill passage 70 that extends from complementary delivery port 69. The internal cavity 22 is thereby also pressurized with oil. The oil delivered to the internal cavity 22 provides for both cooling of the electric motor 24 and lubrication. The oil delivered to the internal cavity 22 also lubricates the drive shaft 26 bearing surface when it travels from the internal cavity 22 through the lubrication passages 72 to the annular ring 73. Further, at the same time, any air trapped in the internal cavity 22 is bled from the internal cavity 22 through the purge passage 74, the through passage 77 in the pumping ring 42, the channel 78 in the pumping ring 42, and the groove 80 in the external plate 40 in that order to the suction port 64. Purging of any air trapped in the internal cavity 22 assures that the internal cavity is fully lubricated and that there are no air pockets within the internal cavity that are not filled with liquid lubricant. Additionally, this purge pathway defined by the purge passage 74, through passage 77, channel 78, and groove 80 that connects the internal cavity 22 to the suction port 64 provides a route for pressurized oil to exit the internal cavity 22, thereby providing for circulation of the cooling/lubrication oil through the internal cavity 22 from the complementary delivery port 69 back to the suction port 64.

While the oil pump 10 has been described above by example as being a gerotor-type fluid pump, the oil pump may be another type of positive displacement pump such as an impeller-type pump or a vane-type pump, such that the rotating element of the pumping arrangement may take other forms which may include, by way of non-limiting example, an impeller.

Figure 10B:
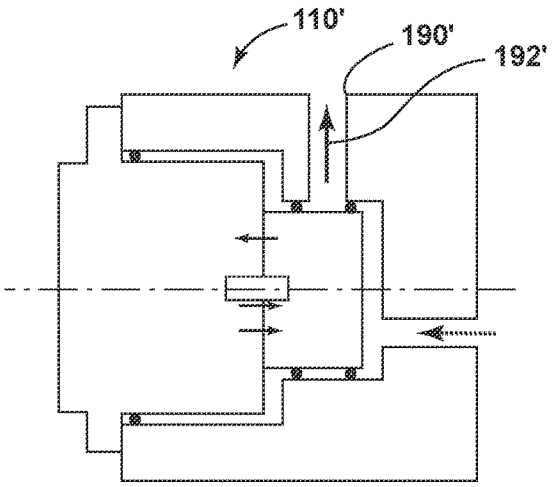
FIGS. 10(*a*) and 10(*b*) are schematic views of a positive displacement fluid pump in accordance with some embodiments of the disclosure.
Figure 10A:
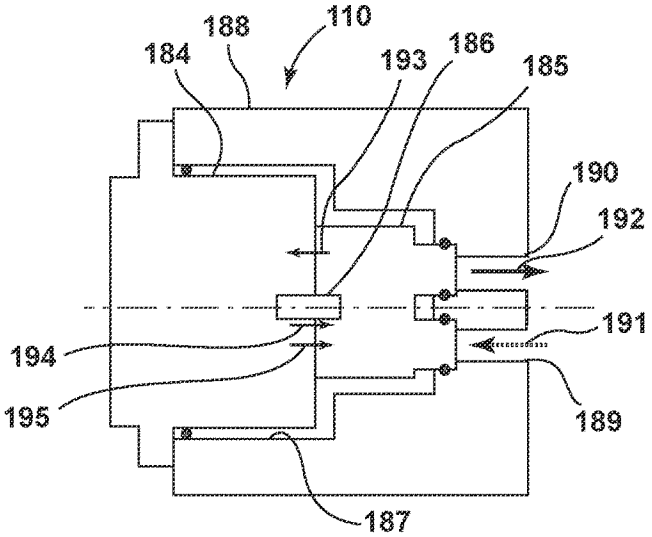

Turning now to FIGS. 10(*a*)-14(*b*), depending on factors including the arrangement of the pump interface and whether or not the pump is submerged in oil in the oil reservoir, there are various configurations to implement the cooling, lubrication, and air purging disclosed above. Additionally, in any of these configurations, the high pressure outlet of the pump may be an axial outlet or a radial outlet as described above and also in more detail below.

With reference to FIGS. 10(*a*) and 10(*b*), in one embodiment the internal motor cavity/chamber of the pump 110 is not submerged in oil in the oil reservoir (i.e., the pump motor chamber is dry). As shown schematically, the pump 110 includes a motor 184, and a pumping section 185 connected to the motor 184 by a shaft 186. The motor 184 is disposed in a cavity/chamber 187 within a pump housing 188. An isolated low pressure suction inlet 189 (i.e., the inlet 189 is sealed from the chamber 187) and an isolated high pressure delivery outlet 190 (i.e., the outlet 190 is sealed from the chamber 187) are connected to the pumping section 185 through the housing 188. Both the inlet 189 and outlet 190 are axially disposed. Low pressure fluid flow is shown by dashed-line arrows while high pressure fluid flow is shown by solid-line arrows. The inlet 189 draws in low pressure fluid from the reservoir to the pumping section 185 at arrow 191, and the outlet 190 delivers high pressure fluid from the pumping section 185 at arrow 192. Cooling and lubrication of the motor 184 in the chamber 187 is accomplished by supplying high pressure fluid from the delivery port of the pumping section 185 through an orifice on the high pressure delivery port at arrow 193. Lubrication of the bearing surface of the rotor shaft 186 is accomplished by delivery of high pressure fluid at arrow 194, in this case from the chamber 187 down to the pumping section 185 through the bearing clearance and out the low pressure suction port volume of the pumping section 185. Purging of air is accomplished by venting air through the top of the pressurized (via high pressure fluid) chamber 187 and out the low pressure suction port volume of the pumping section 185 at arrow 195. The embodiment of the pump 110 shown in FIG. 10(*a*) is the same as the arrangement of pump 10 shown in FIGS. 2-9 above.

The pump 110' shown in FIG. 10(*b*) is the same as the pump 110 in FIG. 10(*a*) except that the high pressure outlet 190' is oriented in the radial direction for radial delivery of high pressure oil from the pump 110' at arrow 192'. The pump 110' otherwise has the same configuration as the pump 110.

Figure 11B:
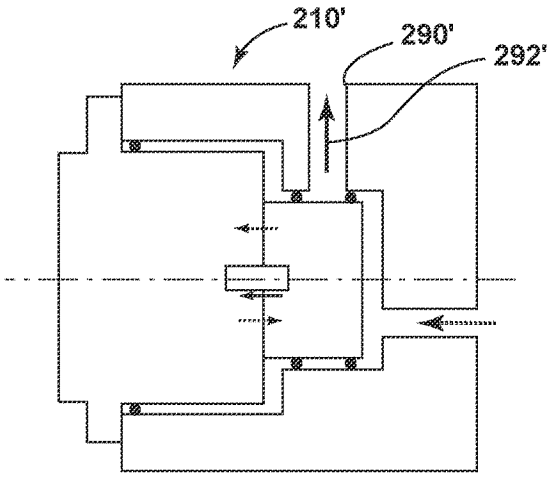
FIGS. 11(*a*) and 11(*b*) are schematic views of other embodiments of a positive displacement fluid pump in accordance with the disclosure.
Figure 11A:
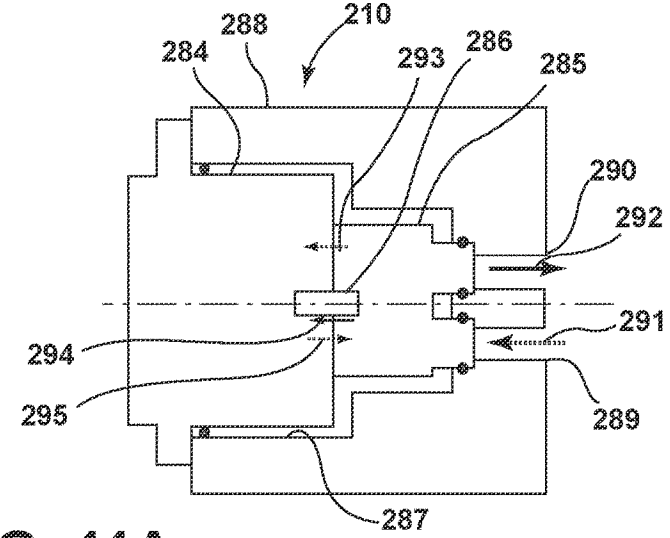

With reference to FIGS. 11(*a*) and 11(*b*), in another embodiment the internal motor cavity/chamber of the pump 210 is not submerged in oil in the oil reservoir (i.e., the pump motor chamber is dry). As shown schematically, the pump 210 includes a motor 284, and a pumping section 285 connected to the motor 284 by a shaft 286. The motor 284 is disposed in a cavity/chamber 287 within a pump housing 288. An isolated low pressure suction inlet 289 and an isolated high pressure delivery outlet 290 are connected to the pumping section 285 through the housing 288. Both the inlet 289 and outlet 290 are axially disposed. Low pressure fluid flow is shown by dashed-line arrows while high pressure fluid flow is shown by solid-line arrows. The inlet 289 draws in low pressure fluid from the reservoir to the pumping section 285 at arrow 291, and the outlet 290 delivers high pressure fluid from the pumping section 285 at arrow 292. Cooling and lubrication of the motor 284 in the chamber 287 is accomplished at arrow 293 by supplying low pressure fluid from the suction port of the pumping section 285 through the dual and/or side low pressure suction ports of the pumping section 285, the shaft 286 bearing clearance, and/or a hole in the shaft 286. Lubrication of the bearing surface of the rotor shaft 286 is accomplished by delivery of high pressure fluid at arrow 294, in this case from the lower pressure suction port volume of the pumping section 285 up to the motor 284 through the shaft bearing clearance and back out the low pressure suction port volume. Purging of air is accomplished by venting air through the top of the unpressurized (via low pressure fluid) chamber 287 and out the low pressure suction port volume of the pumping section 285 at arrow 295.

The pump 210' shown in FIG. 11(*b*) is the same as the pump 210 in FIG. 11(*a*) except that the high pressure outlet 290' is oriented in the radial direction for radial delivery of high pressure oil from the pump 210' at arrow 292'. The pump 210' otherwise has the same configuration as the pump 210.

Figure 12B:
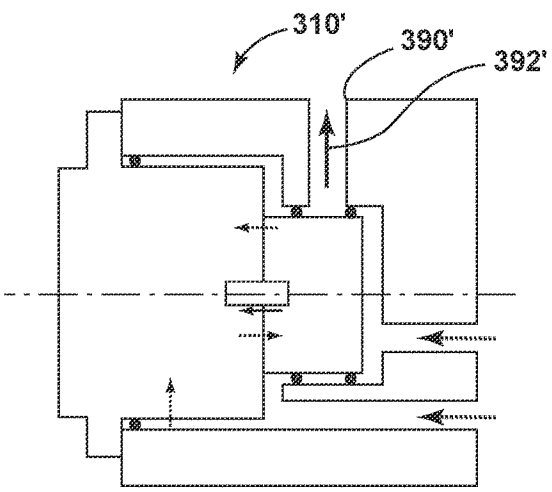
FIGS. 12(*a*) and 12(*b*) are schematic views of yet other embodiments of a positive displacement fluid pump in accordance with the disclosure.
Figure 12A:
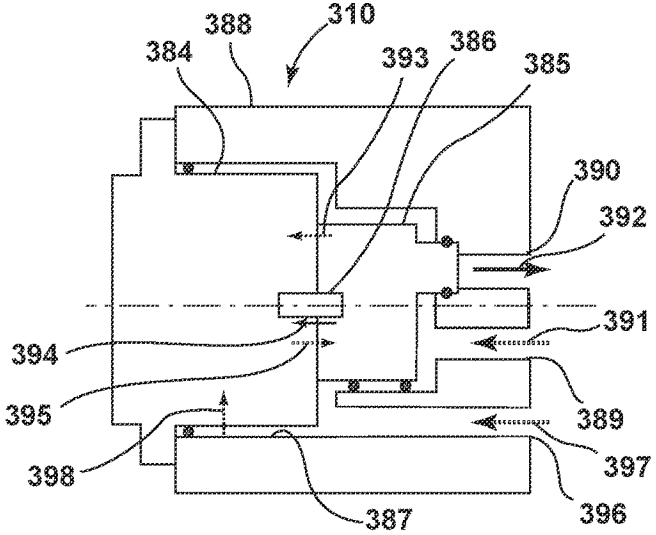

With reference to FIGS. 12(*a*) and 12(*b*), in yet another embodiment the internal motor cavity/chamber of the pump 310 is submerged in oil in the oil reservoir (i.e., the pump motor chamber is wet). As shown schematically, the pump 310 includes a motor 384, and a pumping section 385 connected to the motor 384 by a shaft 386. The motor 384 is disposed in a cavity/chamber 387 within a pump housing 388. An isolated low pressure suction inlet 389 and an isolated high pressure delivery outlet 390 are connected to the pumping section 385 through the housing 388. Both the inlet 389 and outlet 390 are axially disposed. Low pressure fluid flow is shown by dashed-line arrows while high pressure fluid flow is shown by solid-line arrows. The inlet 389 draws in low pressure fluid from the reservoir to the pumping section 385 at arrow 391, and the outlet 390 delivers high pressure fluid from the pumping section 385 at arrow 392. The housing 388 includes an additional low pressure inlet 396 that provides fluid communication between the oil reservoir and the chamber 387 at arrow 397. Cooling and lubrication of the motor 384 in the chamber 387 is accomplished at arrow 393 by supplying low pressure fluid from the suction port of the pumping section 385 through the dual and/or side low pressure suction ports of the pumping section 385, the shaft 386 bearing clearance, and/or a hole in the shaft 386. Lubrication of the bearing surface of the rotor shaft 386 is accomplished by delivery of high pressure fluid at arrow 394, in this case from the low pressure suction port volume of the pumping section 385 up to the motor 384 through the shaft bearing clearance and back out the low pressure suction port volume. Purging of air is accomplished by venting air through the top of the unpressurized (via low pressure fluid) chamber 387 and out the low pressure suction port volume of the pumping section 385 at arrow 395. The pump 310 further includes a radial port at arrow 398 that provides low pressure fluid from the chamber 387 to the motor 384.

The pump 310' shown in FIG. 12(*b*) is the same as the pump 310 in FIG. 12(*a*) except that the high pressure outlet 390' is oriented in the radial direction for radial delivery of high pressure oil from the pump 310' at arrow 392'. The pump 310' otherwise has the same configuration as the pump 310.

Figure 13B:
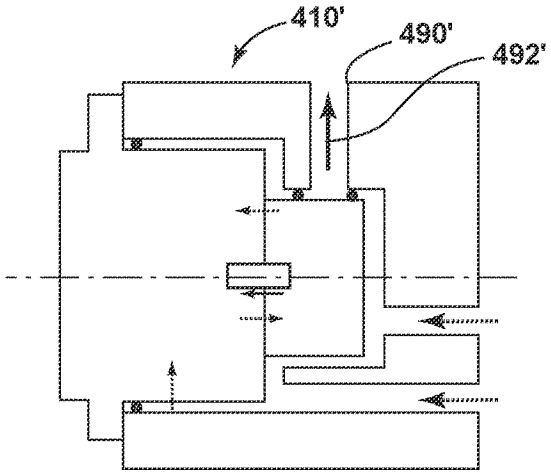
FIGS. 13(*a*) and 13(*b*) are schematic views of yet other embodiments of a positive displacement fluid pump in accordance with the disclosure.
Figure 13A:
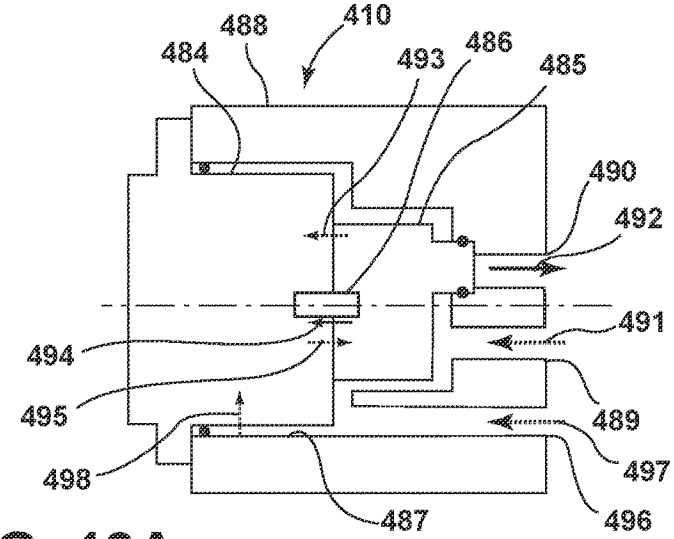

With reference to FIGS. 13(*a*) and 13(*b*), in yet another embodiment the internal motor cavity/chamber of the pump 410 is submerged in oil in the oil reservoir (i.e., the pump motor chamber is wet). As shown schematically, the pump 410 includes a motor 484, and a pumping section 485 connected to the motor 484 by a shaft 486. The motor 484 is disposed in a cavity/chamber 487 within a pump housing 488. In contrast to pump 310, pump 410 includes an open low pressure suction inlet 489 (i.e., the inlet 489 is open to and in fluid communication with the chamber 487). Pump 400 also includes an isolated high pressure delivery outlet 490 (i.e., the outlet 490 is sealed from the chamber 487). The open inlet 489 and isolated outlet 490 are connected to the pumping section 485 through the housing 488. Both the inlet 489 and outlet 490 are axially disposed. Low pressure fluid flow is shown by dashed-line arrows while high pressure fluid flow is shown by solid-line arrows. The inlet 489 draws in low pressure fluid from the reservoir to the pumping section 485 at arrow 491, and the outlet 490 delivers high pressure fluid from the pumping section 485 at arrow 492. The housing 488 includes an additional low pressure inlet 496 that provides fluid communication between the oil reservoir and the chamber 487 at arrow 497. Cooling and lubrication of the motor 484 in the chamber 487 is accomplished at arrow 493 by supplying low pressure fluid from the suction port of the pumping section 485 through the dual and/or side low pressure suction ports of the pumping section 485, the shaft 486 bearing clearance, and/or a hole in the shaft 486. Lubrication of the bearing surface of the rotor shaft 486 is accomplished by delivery of high pressure fluid at arrow 494, in this case from the low pressure suction port volume of the pumping section 485 up to the motor 484 through the shaft bearing clearance and back out the low pressure suction port volume. Purging of air is accomplished by venting air through the top of the unpressurized (via low pressure fluid) chamber 487 and out the low pressure suction port volume of the pumping section 485 at arrow 495. The pump 410 further includes a radial port at arrow 498 that provides low pressure fluid from the chamber 487 to the motor 484.

The pump 410' shown in FIG. 13(*b*) is the same as the pump 410 in FIG. 13(*a*) except that the high pressure outlet 490' is oriented in the radial direction for radial delivery of high pressure oil from the pump 410' at arrow 492'. The pump 410' otherwise has the same configuration as the pump 410.

Figure 14B:
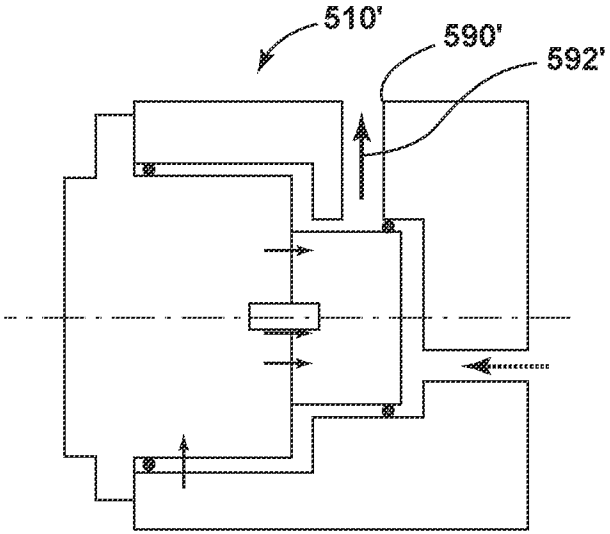
FIGS. 14(*a*) and 14(*b*) are schematic views of yet other embodiments of a positive displacement fluid pump in accordance with the disclosure.
Figure 14A:
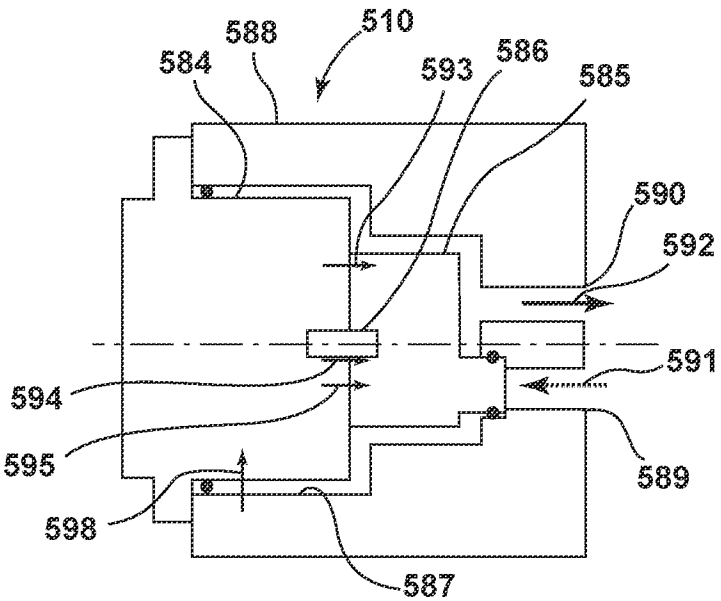

With reference to FIGS. 14(*a*) and 14(*b*), in yet another embodiment the internal motor cavity/chamber of the pump 510 is submerged in oil in the oil reservoir (i.e., the pump motor chamber is wet). As shown schematically, the pump 510 includes a motor 584, and a pumping section 585 connected to the motor 584 by a shaft 586. The motor 584 is disposed in a cavity/chamber 587 within a pump housing 588. Pump 510 includes an isolated low pressure suction inlet 589 (i.e., the inlet 589 is sealed from the chamber 587), while the pump 510 includes an open high pressure delivery outlet 590 (i.e., the outlet 590 is open to and in fluid communication with the chamber 587). The isolated inlet 589 and open outlet 590 are connected to the pumping section 585 through the housing 588. Both the inlet 589 and outlet 590 are axially disposed. Low pressure fluid flow is shown by dashed-line arrows while high pressure fluid flow is shown by solid-line arrows. The inlet 589 draws in low pressure fluid from the reservoir to the pumping section 585 at arrow 591, and the outlet 590 delivers high pressure fluid from the pumping section 585 at arrow 592. Cooling and lubrication of the motor 584 in the chamber 587 is accomplished at arrow 593 by supplying high pressure fluid from the delivery port of the pumping section 585 through the open connection between the outlet 590 and the chamber 587, and out the low pressure suction port volume of the pumping section 585. Lubrication of the bearing surface of the rotor shaft 586 is accomplished by delivery of high pressure fluid at arrow 594, in this case from the high pressure fluid in the chamber 587 through the shaft bearing clearance and back out the low pressure suction port volume. Purging of air is accomplished by venting air through the top of the pressurized (via high pressure fluid) chamber 587 and out the low pressure suction port volume of the pumping section 585 at arrow 595. The pump 510 further includes a radial port at arrow 598 that provides high pressure fluid from the chamber 587 to the motor 584.

The pump 510' shown in FIG. 14(*b*) is the same as the pump 510 in FIG. 14(*a*) except that the high pressure outlet 590' is oriented in the radial direction for radial delivery of high pressure oil from the pump 510' at arrow 592'. The pump 510' otherwise has the same configuration as the pump 510.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements by ordinal terms, for example "first," "second," and "third," are used for clarity, and are not to be construed as limiting the order in which the claim elements appear. Any reference to claim elements in the singular, for example, using the articles "a," "an," "the" or "said," is not to be construed as limiting the element to the singular.

The invention claimed is:

1. A positive displacement fluid pump comprising:

a housing defining an internal cavity;

a motor having a drive shaft that rotates about an axis, the motor being housed within the internal cavity of the housing;

an internal plate adjacent the motor and including a central bore through which the drive shaft extends;

an external plate including an inlet in fluid communication with a suction port and an outlet in fluid communication with a delivery port;

a pumping ring sandwiched between the internal and external plates; and a pumping arrangement rotatably coupled to the drive shaft such that rotation of the pumping arrangement by the drive shaft causes fluid to be pumped from the suction port to the delivery port, the pumping arrangement being located within the pumping ring and axially between the internal plate and the external plate, wherein the internal plate includes an inwardly-facing face surface, an opposite outwardly-facing face surface, and a complementary delivery port formed in the outwardly-facing face surface and in fluid communication with the delivery port of the external plate, and the internal plate further includes a fill passage connected to the complementary delivery port, the fill passage extending to the inwardly-facing face surface of the internal plate and being in fluid communication with the internal cavity of the housing, wherein fluid pumped by the pumping arrangement is delivered to the internal cavity of the housing through the fill passage.

2. The positive displacement fluid pump of claim 1, wherein the fill passage is cylindrical.

3. The positive displacement fluid pump of claim 1, wherein the internal plate includes a hub protruding from the inwardly-facing face surface of the internal plate, the central bore being formed at least in part in the hub, and the hub including at least one lubrication passage connecting the internal cavity of the housing to the central bore.

4. The positive displacement fluid pump of claim 3, wherein the at least one lubrication passage is cylindrical.

5. The positive displacement fluid pump of claim 3, including two of said lubrication passages.

6. The positive displacement fluid pump of claim 5, wherein the two lubrication passages are offset approximately 180 degrees from each other in a radial direction around the hub.

7. The positive displacement fluid pump of claim 1, further including a purge pathway from the internal cavity to the suction port, the purge pathway extending through the internal plate and the pumping ring.

8. The positive displacement fluid pump of claim 7, wherein the purge pathway further extends from the pumping ring into the external plate.

9. The positive displacement fluid pump of claim 8, wherein:

the internal plate includes an inwardly-facing face surface and an opposite, outwardly-facing face surface adjacent the pumping ring;

the external plate includes an inwardly-facing face surface adjacent the pumping ring, and a groove formed in the inwardly-facing face surface of the external plate, the groove being connected to the suction port;

the pumping ring including an inwardly-facing face surface adjacent the outwardly-facing face surface of the internal plate, and an opposite, outwardly-facing face surface adjacent the inwardly-facing face surface of the external plate, the outwardly-facing face surface of the pumping ring including a channel formed therein, one end of the channel being connected to the groove in the external plate and another end of the channel being connected to a passage that extends through the pumping ring from the outwardly-facing face surface of the pumping ring to the inwardly-facing face surface of the pumping ring; and the internal plate including a purge passage extending from the outwardly-facing face surface of the internal plate to the inwardly-facing face surface of the internal plate, the purge passage in the internal plate being connected to the passage in the pumping ring;

wherein the purge pathway is defined by the purge passage in the internal plate, the passage in the pumping ring, the channel in the pumping ring, and the groove in the external plate.

10. The positive displacement fluid pump of claim 9, wherein the purge passage protrudes from the internal plate into the internal cavity of the housing.

11. The positive displacement fluid pump of claim 9, wherein the purge passage is in fluid communication with the internal cavity of the housing.

12. The positive displacement fluid pump of claim 1, wherein the pumping arrangement and the pumping ring are made of materials having a similar coefficient of thermal expansion (CTE).

13. The positive displacement fluid pump of claim 1, wherein the pumping arrangement includes a rotating element that is an inner gear rotor mounted on the drive shaft, and the pumping arrangement further includes an outer gear rotor engaged and driven by the inner gear rotor, the inner gear rotor and outer gear rotor together defining a plurality of variable volume pumping chambers in fluid communication with the suction port and the delivery port.

14. The positive displacement fluid pump of claim 13, wherein the pumping ring is an eccentric ring including a circular gear rotor bore that is offset from the axis of the drive shaft.

15. The positive displacement fluid pump of claim 1, wherein the motor is an electric motor.

16. The positive displacement fluid pump of claim 1, wherein the inlet is arranged in an axial direction aligned with the axis of the drive shaft, and the outlet is arranged in one of: (i) the axial direction; or (ii) a radial direction extending radially with respect to the axis of the drive shaft.

17. The positive displacement fluid pump of claim 1, wherein one of: (i) the inlet and outlet are isolated from the internal cavity; (ii) the inlet is isolated from the internal cavity and the outlet is open to the internal cavity; or (iii) the inlet is open to the internal cavity and the outlet is isolated from the internal cavity.

18. The positive displacement fluid pump of claim 1, wherein one of the suction port and the delivery port is in fluid communication with the internal cavity such that fluid is either delivered from the suction port or the delivery port to the internal cavity.

19. A method of cooling and lubricating the positive displacement pump of claim 1, including the steps of:

forming at least one lubrication passage in a hub of the internal plate, the hub being a smaller diameter portion that protrudes from the inwardly-facing face surface of the internal plate, and the central bore being formed at least in part in the hub, the at least one lubrication passage connecting the internal cavity of the housing to the central bore;

wherein fluid is delivered from the internal cavity of the housing to the central bore through the at least one lubrication passage.

20. The method of claim 19, further including the steps of:

forming a groove in the inwardly-facing face surface of the external plate;

forming a channel in an outwardly-facing face surface of the pumping ring, one end of the channel being connected to the groove in the external plate and another end of the channel being connected to a passage that extends through the pumping ring from the outwardly-facing face surface of the pumping ring to an inwardly-facing face surface of the pumping ring; and forming a purge passage that extends from an outwardly-facing face surface of the internal plate to an inwardly-facing face surface of the internal plate, the purge passage in the internal plate being connected to the passage in the pumping ring;

wherein air is bled from the internal cavity of the housing serially through the purge passage in the internal plate, the passage in the pumping ring, the channel in the pumping ring, and the groove in the external plate to the suction port.

21. The method of claim 20, wherein fluid delivered to the internal cavity of the housing through the fill passage is recirculated from the internal cavity to the suction port serially through the purge passage in the internal plate, the passage in the pumping ring, the channel in the pumping ring, and the groove in the external plate.

* * * * *